US006318667B1

(12) United States Patent
Morton

(10) Patent No.: US 6,318,667 B1
(45) Date of Patent: Nov. 20, 2001

(54) STEALTH WEAPON SYSTEMS

(76) Inventor: Raymond C. Morton, 5809 86th St., Lubbock, TX (US) 79424-3601

( * ) Notice: Subject to any disclaimer, the term of this patent is extended or adjusted under 35 U.S.C. 154(b) by 0 days.

(21) Appl. No.: 09/538,408

(22) Filed: Mar. 29, 2000

Related U.S. Application Data

(60) Provisional application No. 60/127,099, filed on Mar. 31, 1999.

(51) Int. Cl.[7] ..... F41G 7/00

(52) U.S. Cl. ..... 244/3.14; 244/3.11; 244/3.15; 244/3.19; 244/3.21; 244/3.24; 342/2; 342/4; 342/62; 342/63; 342/66; 342/357.06; 342/357.08; 701/207; 701/213

(58) Field of Search ..... 244/3.1–3.14, 244/3.24–3.3, 3.15, 3.21, 3.22; 342/61–68, 70–72, 357.01–357.17, 1–10; 701/200, 207, 213–216

(56) References Cited

U.S. PATENT DOCUMENTS

| | | | | |
|---|---|---|---|---|
| Re. 36,298 | | 10/1999 | Scherrer et al. . | |
| 1,384,868 | | 7/1921 | Sperry et al. . | |
| 2,436,578 | | 2/1948 | Korn et al. . | |
| 3,838,425 | | 9/1974 | Ishimitsu et al. . | |
| 3,997,899 | | 12/1976 | Rolsma . | |
| 4,019,699 | | 4/1977 | Wintersdorff et al. . | |
| 4,143,836 | * | 3/1979 | Rieger | 244/3.15 |
| 4,883,239 | * | 11/1989 | Lachmann et al. | 244/3.15 |
| 5,102,065 | * | 4/1992 | Couderc et al. | 244/3.11 |
| 5,131,602 | * | 7/1992 | Linick | 244/3.14 |
| 5,141,175 | * | 8/1992 | Harris | 244/3.25 |
| 5,647,558 | * | 7/1997 | Linick | 244/3.11 |
| 5,657,947 | | 8/1997 | Mayersak . | |
| 5,717,397 | | 2/1998 | Ruszkowski . | |
| 5,826,819 | | 10/1998 | Oxford . | |
| 5,866,838 | | 2/1999 | Mayersak . | |
| 6,016,990 | * | 1/2000 | Small | 244/3.11 |

* cited by examiner

*Primary Examiner*—Bernarr E. Gregory
(74) *Attorney, Agent, or Firm*—Wendell Coffee

(57) ABSTRACT

A winged bomb is launched from a launch aircraft and glides to a target. During the glide the winged bomb follows a calculated guide path stored in a on board computer, with correction generated by the computer using data from an altimeter and global positioning receiver. Near the termination of the glide a television camera is activated and transmits signals to a remote location from which final correction are manually generated and transmitted by radio to the bomb. The bomb is designed with low radar cross section.

11 Claims, 2 Drawing Sheets

STEALTH WEAPON SYSTEMS

PROVISIONAL PATENT APPLICATION

Applicant filed a Provisional Application on this subject matter on Mar. 31, 1999 Ser. No. 60/127,099.

BACKGROUND OF THE INVENTION (1) Field of the Invention

This invention relates to bombs dropped from aircraft and more particularly to guiding a gliding bomb which is maneuverable. Also this invention contemplates a bomb which is detectable neither visually on dark nights nor by radar nor by infrared instrumentation.

Another purpose of this invention is to guide bombs accurately from aircraft to target and make economies of government and protect aircrews. The use of CRUISE MISSILES for remote attack on hostile targets is very expensive, puts aircrews in jeopardy, and is less than 100% accurate. The system of this invention can provide an effective covert solution to international problems.

The term "bomb" is used to indicate any weapon mass and is not intended to be restricted to explosive material in a container. The term "flying bomb" is used to mean a bomb having lift characteristics when moving through the atmosphere. Usually the lift elements would be glider wings.

(2) Description of the Related Art

RUSZKOWSKI JR., in U.S. Pat. No. 5,717,397, discloses a bomb which has a low radar cross section. This patent discloses the techniques deflecting the radar rays and also absorbing the radar rays. Lacking any engine there would be no infrared radiation to be detected. A dark colored bomb such as the color black is almost invisible on a dark night. Also snap out fins are disclosed.

MAYERSAK in U.S. Pat. Nos. 5,866,838, 5,657,947, and 5,507,452 teaches the possibility of a bomb which is maneuverable by use global positioning satellite (hereafter GPS) to determine the position of the bomb and to guide the bomb to a target.

OXFORD in U.S. Pat. No. 5,826,819 discloses a bomb which is guidable to some extent by having a radio wave illuminated target and the method to guide a bomb to the illuminated target.

The techniques for reducing the radar cross section of is flying objects are well known.

SUMMARY OF THE INVENTION (1) Progressive Contribution to the Art

The system of this invention is a weight engine driven flying bomb using stealth technology, Global Positioning Satellite (GPS) guidance, and remote guidance update to deliver a large warhead at a fraction of the cost of a cruise missile (approximately 5% of the cost,) and with greater accuracy.

The purpose of this invention is to provide the armed forces with a weapon of great accuracy that would be relatively immune from defensive measures and permit launch from a greater stand-off distance. Because of its extreme accuracy and low launch aircraft attrition, the weapon would deliver a heavy warhead at an extremely low cost.

The weapon would use stealth technology. Stealth technology is, for a full sized aircraft (i.e., F-117 by Lockheed) a very highly developed and expensive art. For this weapon, Radar Cross Section would be reduced to an incredibly low, virtual non-existent figure.

Several reasons are suggested for this.

A. It is weight powered, and will not require the complexity of radar reflection reduction in inlets and ducting common to internal combustion engine installations.

B. Profile, as presented to enemy radar systems, will be faceted to eliminate reflective corners and the total exterior of the airframe will be covered with radar absorbent material (RAM) and constructed of RAM laminates.

C. The strength of the airframe will be obtained from the weight engine (the bomb) and the balance molded out of RAM composites. The signature of the approaching weapon will be so low that it would never get out of the noise of enemy radars.

D. Guidance would be two-fold: Basic guidance would be by using a computer calculated programmed glide path that would be continually monitored and corrected by Global Positioning Satellite (GPS) input. Circular Error Probable (CEP) would be on the order of 10 feet. The calculated guide path and in flight GPS corrections would bring the bomb to the close proximity of the potential target. A remote control link would or could be used for final correctional update. On arrival, at a pre-set location, a TV camera would briefly come on and transmit signals of a picture to a control location where a recording would be made and a controller would do the final guidance, if necessary. The control location might be the launch aircraft. The recording would also provide a damage assessment by evaluating location of impact. The TV transmission should not be detected, and in any case would not provide adequate response time for counter measures.

Optimum Deployment

The ultimate couple would be a stealth aircraft carrying a bomb of this invention. The use of this combination would reduce or would negate the commitment of the ground troops into the theater. The command and control facilities of the enemy would be neutralized, defensive aircraft installations destroyed, radar units knocked out, and supply depots reduced.

Operation Detail

The flying bomb would be designed to conform to mission requirements. For example, weight of war head would determine wing size and geometry. Control could be by ailerons and elevators or spoilers, elevons and speed brakes, or a combination of elements. The major advantage of the flying bomb is that a location that is under attack will have no warning due to the faceted zero RCS corners, RAM coating and composite materials used through out and the absence of infrared radiation from internal combustion engines. The ideal launch situation would be from a stealth type aircraft bomb-bay. However, the flying bomb could be taken to the launch position exposed on a wing pylon.

This invention discloses a bomb with a wings or vanes or other lift surfaces which will permit a launched bomb to glide for considerable distance. For example the bomb can be supplied with lifting surfaces so that it has a guide path of twenty to one from 20,000 ft. altitude. Therefore, a launching plane at twenty thousand feet altitude could launch a bomb at a distance of over 65 nautical miles from the target. With such a distance to travel the bomb must be carefully guided through its glide path.

By use of current technology, people with ordinary skill in computer programming may readily compute a glide path. Data input to the previously written computer program before launch would include the altitude of the plane, the altitude of the target, the location of the plane and the location of the target. From this, the programmed computer can plot a glide path for the bomb to follow from a launch position many miles from the target. This calculated glide path program is transferred to a computer in the bomb which would direct the control surfaces of the maneuverable bomb to follow the glide path.

The current technology of GPS location can accurately find a determined position and detect whether the bomb is at the calculated geoposition of the calculated glide path. From this data input, any deviation from the calculated glide path may be corrected by changing the control surfaces the bomb. Likewise the altitude can be determined within satisfactory limits by an atmospheric altimeter. Also this data information can be manipulated by an on board bomb computer so if its determined altitude deviates from the calculated altitude, the bomb can be brought back to the calculated altitude.

For high precision the bomb may carry a television camera which is pointed in the direction of the travel of the bomb. When the bomb is near the target, this television will show the target. This data in the form of television signals is transmitted to a remote receiver in a control aircraft. Manually operated signals are transmitted to the bomb to override any other guidance control of the bomb. In this manner the bomb may be guided with the aid of the television camera to pin point the target. The television would be operable for a short time only because as soon as the television camera is activated the bomb could be located.

It will be understood from this description the system depends that the bomb is gravity powered. It travels downward along the glide path. Gravity will cause it to travel considerable distance. Also until the television camera is activated, the bomb can be discovered only with extreme difficulty. At the distance from the target the launch aircraft could very well not be noticed. If it were noticed there would be nothing to indicate that it had launched the bomb. Also after the launch, damage to the launch aircraft would not jeopardize the effectiveness of the bomb if the manual control during the final seconds of the flight of the bomb were from another aircraft. Except for GPS, the only communication the bomb will have with any outside source will be only for the seconds that it was sending television information and receiving the transmitted manually generated guidance. The result would be that there would be slight possibility of damage to the launch and controlled aircraft. Also the bomb would be relatively inexpensive. The computer and the television would be relatively inexpensive by current weapon standards.

Also if the bomb casing and lift surfaces and control vanes etc. made exclusively from non metallic materials the detection of the bomb would be extremely difficult.

(2) Objects of this Invention

An object of this invention is to guide a bomb from a launch aircraft at a extended distance from the target by causing the bomb to glide to the target by wings or other lift surfaces on the bomb.

Another object is to provide a bomb which has a small radar cross section, no infrared radiation, and is difficult to locate by visual sighting.

Another object is to deliver such a vehicle to a target with extreme accuracy.

Another object is to deliver such bomb with a high degree of protection for aircraft personnel which launch and control the bomb.

Further objects are to achieve the above with devices that are sturdy, compact, durable, lightweight, simple, safe, efficient, versatile, energy conserving, and reliable, yet inexpensive and easy to manufacture, install, operate, and maintain.

Other objects are to achieve the above with a method that is rapid, versatile, energy conserving, efficient, and inexpensive, and does not require highly skilled people to operate.

Further objects are to achieve the above with a product that is easy to store, has a long storage life, is safe, versatile, efficient, stable and reliable, yet is inexpensive and easy to manufacture.

The specific nature of the invention, as well as other objects, uses, and advantages thereof, will clearly appear from the following description and from the accompanying drawings, the different views of which are not necessarily scale drawings.

CATALOGUE OF ELEMENTS

As an aid to correlating the terms of the claims to the exemplary drawing(s), the following catalog of elements and steps is provided:

10 Launch Aircraft
12 Flying Bomb
14 Glide Path
16 Global Positioning Satellite
18 Target
20 Bomb's Geoposition (calculated)
22 Geodistance
24 Altitude (calculated)
26 Determined Bomb's Geoposition
28 Deviation
30 Determined Bomb's Altitude
32 T.V. Camera Referring to FIG. 1 there may be seen schematic represented of launch aircraft 10 and launched flying bomb 12. The computer calculated glide path 14 is shown in dotted lines. Satellite 16 provides global positioning.

At the time of the launch of the flying bomb, a computer aboard the aircraft 10 plotted the calculated glide path 14 to target 18.

This plotted computer calculated guide path 14 was transferred to the computer within the bomb 12 before launch. After the launch the bomb should follow the calculated path 14.

Figure 4:
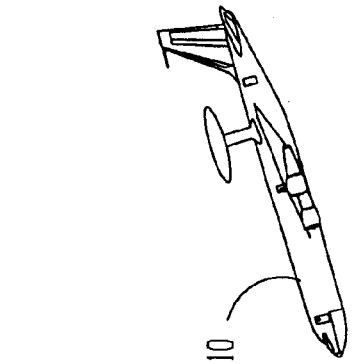
FIG. 4 is a schematic representation of a plan view the flying bomb being guided to its target.
Figure 4:
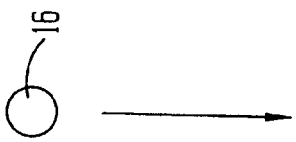
Figure 4:
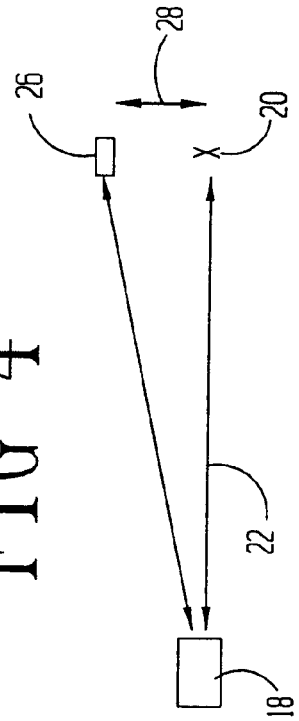
Figure 2:
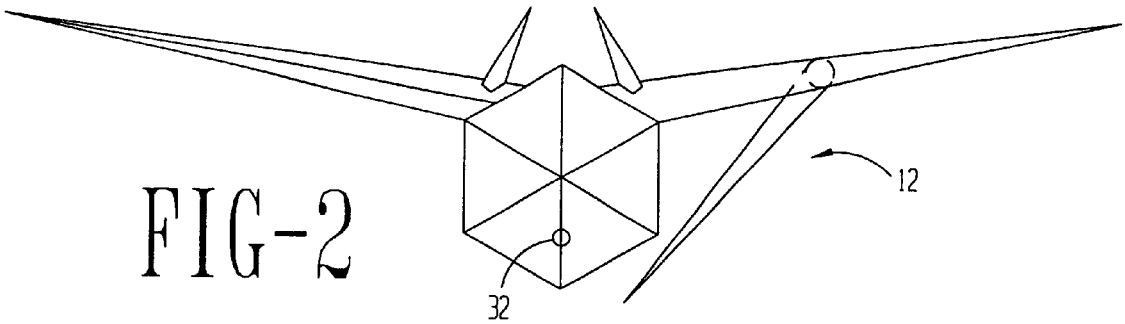
FIG. 2 is a front elevational view of a flying bomb according to this invention with illustration of a wing folded.
Figure 3:
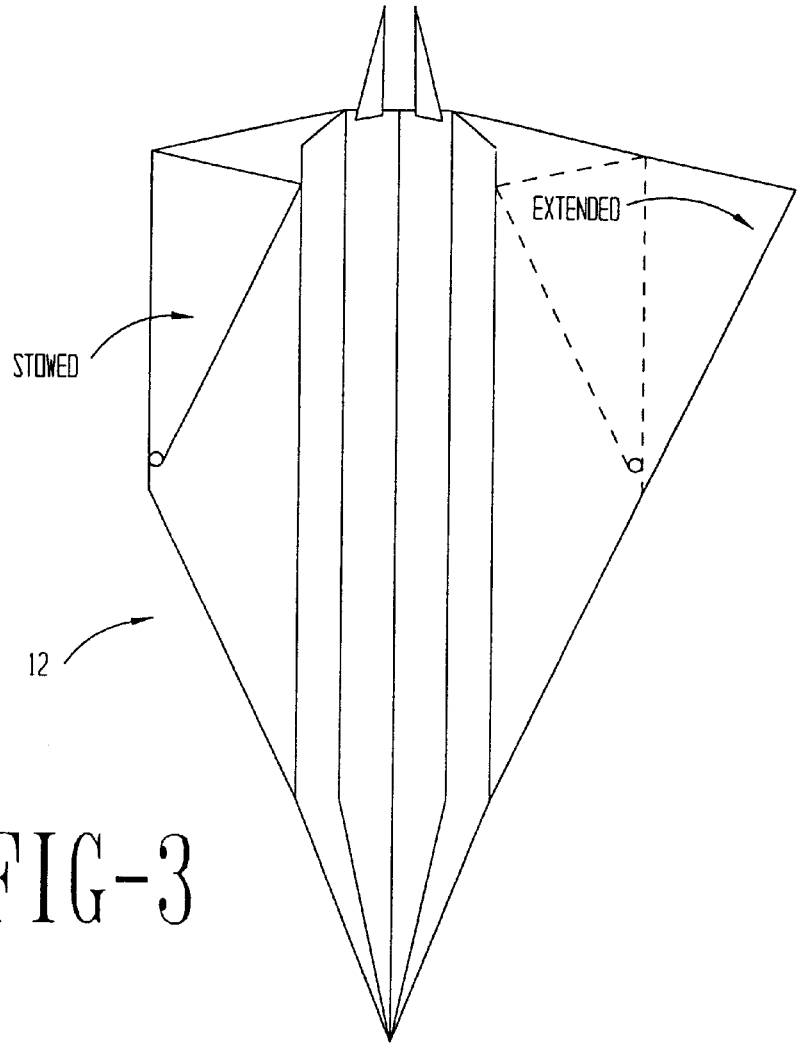
FIG. 3 is a bottom plan view of a flying bomb with an illustration of the folding of the wings.

The bomb has a global positioning receiver whereby it can determine the bomb's exact determined geoposition 26 as shown in FIG. 2. From this exact, determined geoposition, the geodistance 22 to target 18 can be readily calculated. The actual location of the target 18 is known. Then the internal computer on the bomb can determine where the bomb should be according to the computer calculated guide path. FIG. 4 shows that the bomb's calculated position would be at point 20. From the global position the it may be seen that the bomb has deviated 28 by amount which is shown in FIG. 2. As a result of this positioning the vertical vanes on the bomb may be activated to cause the bomb to move toward the calculated guide path.

Figure 1:
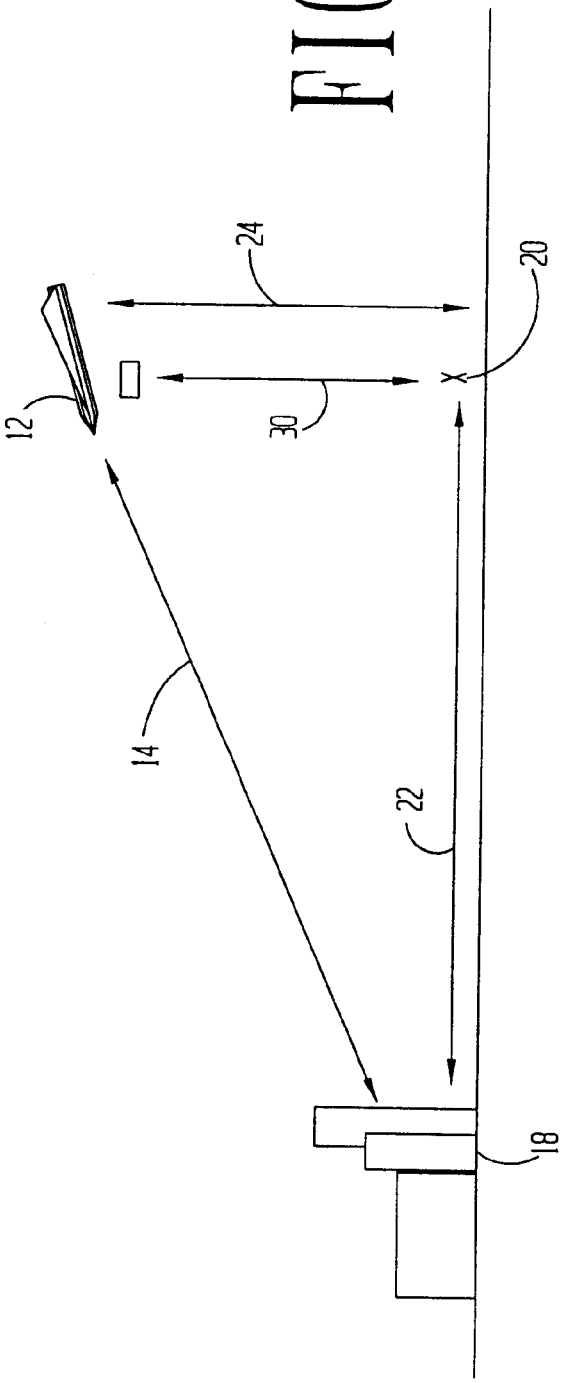
FIG. 1 is a schematic representation of a flying bomb being guided to its target.

Referring to FIG. 1 likewise calculated elevation 24 of the bomb as plotted at calculated geodistance 22 from the target 18 is shown. A barometric altimeter aboard the bomb measures the bomb a measured elevation 30. Therefore the difference in a calculated elevation 24 and measured elevation 30 may be corrected by adjusting the vanes upon the bomb. The corrections for altitude may be made at regular intervals. Likewise the corrections of the geoposition can be made at regular intervals. In this way the bomb may be corrected to follow the calculated glide path. It will be noted that the bomb at this time produces no signals which could be intercepted at the target area to indicate the presence of the bomb.

As the bomb 12 continues along the calculated glide path 14 to the time distance 22 is a preset value, a television camera 32 is activating to view the target 18. The bomb will transmit the signals generated by the television to a control center. At the control center the signals are recorded and also the venue shown by the camera is placed upon a viewing screen at the control center. A manual joy stick within the control center produces correction signals which is transmitted by radio to the bomb 12. These signals override any other signals on the control surfaces. If the distance at which the television is activated is about the distance covered by the bomb in less than sixty (60) seconds the bomb can be maneuvered within the last few seconds to be on the target with pin point accuracy.

If the bomb can be detected only sixty (60) seconds before it reaches the target it is highly unlikely that any counter measures can be taken within that time limit.

The launch aircraft and a control aircraft might or might not be the control center.

As a summary of the steps taken the following sequence is given.

First the computer aboard the launch aircraft is loaded with data of the specific flying bombs on board. For example, the minimum glide angle at all potential atmospheric conditions and range of the flying bomb's for all likely altitudes. Also into the global position and elevation of the target is loaded into the computer. Also available weather data for example atmospheric pressure variations, temperature, winds, etc.

Also additional data would be constantly added to the computer in the launch planes particularly the global position and elevation of the launch planes etc.

From this data, the aircraft computer would continually produce a calculated glide path for the flying bomb from the launch to the target. At launch time this calculated pattern would be transferred by umbilical cable to a bomb calculator on the flying bomb.

The bomb computer while inflight will continually be fed data of the bomb's geolocation as read from a GPS receiver on the bomb. By geolocation of an object is meant the location on the earth surface immediately below the object. The bomb calculator would continually calculate the measured geodistance 22. By the term measured geodistance is meant the geodistance calculated from the GPS data.

The altimeter aboard would also continually measure the altitude.

The computer at regular intervals compares the measured altitude 24 to the calculated altitude 24 each at the same geodistance 22. That is to say the calculator would look at the calculated altitude for the given calculated distance 22. This would be compared to the measured altitude at the corresponding measured distance 22. If the measured altitude was less than the calculated altitude corrections would be made to increase the altitude of the flying bomb. Although the term increased altitude is used it will be understood in actually it would mean that the bomb would change so it did not lose as much altitude over a given distance as otherwise. Likewise if the measured altitude was greater than the calculated altitude at the prescribed distance 22 the bomb controls would change so that the bomb would lose altitude faster than otherwise calculated.

Likewise the measured geoposition 26 at a designated measure geodistance 22 would be compared to the calculated geoposition 20 at the prescribed calculated geodistance 22. If these two positions were not identical that is if the measured geoposition had a deviation 28 from the claculated geoposition changes would be made to change the direction of flight of the bomb so that it would head toward the calculated geoposition.

As a refinement a radar altimeter could be placed upon the bomb. Although a barometric altimeter would normally produce sufficient accuracy in certain weather conditions it might vary. If a radar altimeter was provided it would be limited to the final short time of the flight. For example it might begin use for 60 or 75 seconds before the bomb was expected to reach the target. That is to say that the altitude precision measurement would be a short time before the television activation.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to point out the advantages and the progressive contribution to the military arts and to enable one skilled in the art to make and use the invention. The limits of the invention and the bounds of the patent protection are measured by and defined in the following claims.

I claim as my invention:

1. The method of utilizing a winged bomb which is maneuverable by control surfaces comprising:

a) loading the winged bomb onto a launch aircraft, b) inputting data in the aircraft to a computer program for a calculated glide path of the bomb from the aircraft to a target, c) transferring the calculated guide path program to a bomb computer on board the bomb, then d) releasing the bomb from the aircraft, and e) guiding the bomb along the calculated glide path using the program with the inputted data.

2. The invention as defined in claim 1 further comprising:

f) deploying wings on the bomb after the bomb is released from the aircraft.

3. The invention as defined in claim 1 further comprising:

f) at a predetermined distance from the target on the bomb computer's calculated guide path, creating television signals by activating a television camera on the bomb, directed at the target, g) transmitting the television signals to a control aircraft, h) displaying the view of the television signals in the control aircraft, i) manually generating overriding control signals in the control aircraft, j) transmitting the overriding signals to the bomb, and k) guiding the bomb by the overriding signals.

4. The invention as defined in claim 3 wherein the television signals are also recorded.

5. The invention as defined in claim 1 further comprising:

f) said calculated glide path is for a bomb flight of a maximum distance of ten (10) times the aircraft altitude at the time of the launch.

6. The invention as defined in claim 1 further comprising:

f) said calculated guide path is for a bomb flight of a distance at least equal to the aircraft altitude at the time of the launch.

7. The invention as defined in claim 1 further comprising: while the bomb is on said calculated glide path f) periodically entering data on the bomb computer of a determined position of the bomb by g) reading an altimeter on the bomb, and h) reading the geographic position of the bomb from data derived from a global positioning satellite receiver on the bomb, then i) correcting any deviation of the determined position of the bomb from the calculated glide path position, by j) producing a correction on the bomb computer of the deviation from the calculated path, and k) changing the control surfaces responsive to the correction.

8. The invention as defined in claim 7 further comprising:

l) at a predetermined distance from the target on the bomb computer's calculated guide path, creating television signals by activating a television camera on the bomb, directed at the target, m) transmitting the television signals to a control aircraft, n) displaying the view of the television signals in the control aircraft, o) manually generating overriding control signals in the control aircraft, p) transmitting the overriding signals to the bomb, and q) guiding the bomb by the overriding signals.

9. The invention as defined in claim 8 wherein:

the television signals are also recorded.

10. The invention as defined in claim 7 further comprising:

l) deploying wings on the bomb after the bomb is released from the aircraft.

11. The method of utilizing a winged bomb which is maneuverable by control surfaces comprising:

a) loading the winged bomb onto a launch aircraft, b) inputting data in the aircraft to a computer program for a calculated glide path of the bomb from the aircraft to a target, c) transferring the calculated guide path program to a bomb computer on board the bomb, then d) releasing the bomb from the aircraft, e) guiding the bomb along the calculated glide path using the program with the inputted data , f) deploying wings on the bomb after the bomb is released from the aircraft, g) periodically entering data on the bomb computer of a determined position of the bomb by h) reading an altimeter on the bomb, and i) reading the geographic position of the bomb from data derived from a global positioning satellite receiver on the bomb, then j) correcting any deviation of the determined position of the bomb from the calculated glide path position, by k) producing a correction on the bomb computer of the deviation from the calculated path, l) changing the control surfaces responsive to the correction, m) at a predetermined distance from the target on the bomb computer's calculated guide path, creating television signals by activating a television camera on the bomb, directed at the target, n) transmitting the television signals to a control aircraft, o) displaying and recording the view shown by the television signals in the control aircraft, p) manually producing overriding control signals in the control aircraft, q) transmitting the overriding signals to the bomb, r) guiding the bomb by the overriding signals, s) said calculated glide path is for a bomb flight of a maximum distance of ten (10) times the aircraft altitude at the time of the launch, and t) said calculated guide path is for a bomb flight of a distance at least equal to the aircraft altitude at the time of the launch.

* * * * *